US007830327B2

(12) United States Patent
He

(10) Patent No.: US 7,830,327 B2
(45) Date of Patent: Nov. 9, 2010

(54) LOW COST ANTENNA DESIGN FOR WIRELESS COMMUNICATIONS

(75) Inventor: Ziming He, Irvine, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 138 days.

(21) Appl. No.: 12/152,726

(22) Filed: May 16, 2008

(65) Prior Publication Data

US 2008/0284661 A1 Nov. 20, 2008

Related U.S. Application Data

(60) Provisional application No. 60/930,738, filed on May 18, 2007.

(51) Int. Cl.
*H01Q 1/36* (2006.01)
*H01Q 9/30* (2006.01)

(52) U.S. Cl. ..... 343/828; 343/829; 343/846

(58) Field of Classification Search ..... 343/700 MS, 343/702, 846, 795, 806, 808, 809, 828, 829
See application file for complete search history.

(56) References Cited

U.S. PATENT DOCUMENTS 6,552,686 B2 * 4/2003 Ollikainen et al. .... 343/700 MS
7,113,133 B2 * 9/2006 Chen et al. ..... 343/700 MS

OTHER PUBLICATIONS

R. Garg, P. Bhartia, I. Bahl and A. Ittipiboon, Microstrip Antenna Design Handbook, pp. 620-621, Boston and London: Artech House, 2001.
K.Hirasawa and M. Haneishi. Analysis, Design, and Measurement of Small and Low-Profile Antennas, pp. 161-181, Boston and London: Artech House, 1992.
Constantine A. Balanis. Antenna Theory: Analysis and Design, 2nd Edition, pp. 767-768, New York: J. Wiley & Sons, 1997.

* cited by examiner

*Primary Examiner*—Michael C Wimer
(74) *Attorney, Agent, or Firm*—OC Patent Law Group

(57) ABSTRACT

A low cost and multi-featured antenna is disclosed. The antenna employs a radiating element mounted to a ground plane and having first and second branches spaced above the ground plane forming a generally L shaped planar radiating structure. The antenna can be either linear or circular polarization, and can be either single band or dual band, and only one feeding port is needed to obtain circular polarization. The antenna can be easily applied to various frequency bands.

11 Claims, 10 Drawing Sheets

LOW COST ANTENNA DESIGN FOR WIRELESS COMMUNICATIONS

RELATED APPLICATION INFORMATION

This application claims the benefit under 35 U.S.C. 119 (e) of U.S. provisional patent application Ser. No. 60/930,738, filed on May 18, 2007, the disclosure of which is incorporated herein by reference in its entirety.

FIELD OF THE INVENTION

The present invention relates to antennas for wireless communications systems. More particularly, the present invention relates to antennas for wireless cellular base stations.

BACKGROUND OF THE INVENTION

The number of base station antennas needed for cellular and other wireless communications applications is increasing rapidly due to increased use of mobile wireless communications. Therefore, it is desirable to design low cost base station antennas. At the same time such wireless applications increasingly will require wideband capability. Also some applications require that the antenna can be either linear or circular polarized.

Increasingly, some practical applications also require that the antenna have smaller dimension. For example, antenna installation space restrictions are becoming increasingly problematic due to the limited locations available to install additional antennas for added cellular coverage, especially in urban areas. Also, antenna arrays for providing beam steering or beamwidth adjustment are being deployed and these require several antenna elements, creating further restrictions on the space available for a given antenna element.

Accordingly, a need presently exists for an improved base station antenna design.

SUMMARY OF THE INVENTION

In a first aspect the present invention provides an antenna comprising a ground plane and a radiating element mounted to the ground plane and having first and second branches spaced above the ground plane, wherein the first and second branches form a generally L shaped planar structure spaced above the ground plane. The antenna further comprises a feeding leg supporting the first branch of the radiating element above the ground plane and electrically coupling the first branch to an RF feeding port and a grounding leg supporting the second branch of the radiating element above the ground plane and electrically coupling the second branch to the ground plane.

In a preferred embodiment of the antenna the first and second branches have respective first and second slots therein. Preferably the first and second slots are L shaped. The length of the first and second branches may be approximately equal. Alternatively, the length of the first and second branches may be different and the antenna provides dual band operation with operating frequencies determined by the respective lengths of the first and second branches. The antenna radiating element preferably comprises a thin sheet of conductive material.

The length of the first and second branches may be given by L1 and L2, respectively, the width of the first and second branches by W1 and W2, respectively, the width of the feeding leg by t1, the width of the ground leg by t2, the distance of the ground leg from the branch edge adjacent the feeding leg by d2, the distance of the feeding leg from the branch edge adjacent the ground leg by d1, and the height of the radiating element above the ground plane by H, and these respective antenna dimensions are selected for the desired operating frequency of the antenna. Also, the first and second slot lengths may be selected for the application. As one specific example of these parameters, d1≈d2 and is about 2 mm, t1 is about 2.8 mm, t2 is about 3.0 mm, L1 is about 11.2 mm, L2 is about 11.0 mm, W1≈W2 and is about 6.5 mm, and H is about 10 mm. For example, the antenna with the noted parameters may be adapted for WiMAX applications and the operating frequency is about 2.6 GHz. Also, the antenna bandwidth may be adjusted by changing the height (H) and the width of the two branches (W1 and W2).

In another aspect the present invention provides an antenna adapted for circularly polarized operation, comprising a circuit board, a ground plane generally parallel to the circuit board, and a radiating element coupled to the circuit board and ground plane and having first and second branches, wherein the first and second branches form a generally L shaped planar structure spaced above the circuit board. The antenna further comprises an RF feeding network formed on the circuit board having first and second branches, a first feeding leg supporting the first branch of the radiating element above the circuit board and ground plane and electrically coupled to the first branch of the RF feeding network, a second feeding leg supporting the second branch of the radiating element above the circuit board and ground plane and electrically coupled to the second branch of the RF feeding network, and a grounding leg coupled to the radiating element between the first and second feeding legs and electrically coupling the radiating element to the ground plane.

In a preferred embodiment of the antenna the antenna further comprises an RF feeding port coupled to the RF feeding network and the first and second branch of the RF feeding network provide a 90 degree relative phase difference to the RF signal applied to the first and second feeding legs. The first and second branches may have respective first and second slots therein. The first and second slots may preferably be L shaped.

In another aspect the present invention provides an antenna assembly, comprising a ground plane, a first radiating element mounted to the ground plane and having first and second branches spaced above the ground plane, wherein the first and second branches form a generally L shaped planar structure spaced above the ground plane, a first feeding leg supporting the first branch of the first radiating element above the ground plane and electrically coupling the first branch to an RF feeding port, and a first grounding leg supporting the second branch of the first radiating element above the ground plane and electrically coupling the second branch to the ground plane. The antenna assembly further comprises a second radiating element mounted to the ground plane and having first and second branches spaced above the ground plane, wherein the first and second branches form a generally L shaped planar structure spaced above the ground plane, a second feeding leg supporting the first branch of the second radiating element above the ground plane and electrically coupling the first branch to an RF feeding port, and a second grounding leg supporting the second branch of the first radiating element above the ground plane and electrically coupling the second branch to the ground plane.

In a preferred embodiment of the antenna assembly the first and second radiating elements are adapted to operate at different frequencies. The first and second branches of each of the first and second radiating elements preferably have respective first and second slots therein.

Further aspects and features of the invention will be appreciated from the following detailed description.

DETAILED DESCRIPTION OF THE INVENTION

The present invention provides a simple and low cost antenna design. In a preferred embodiment, the antenna dimension is less than half of a patch antenna. The antenna can be either linear or circular polarized, and can be either single band or dual band. Also, only one feeding port is needed. Because of its small dimension and multiple features, the present invention is particularly useful in applications where only a small antenna space is available and in active antenna array application.

Figure 1:
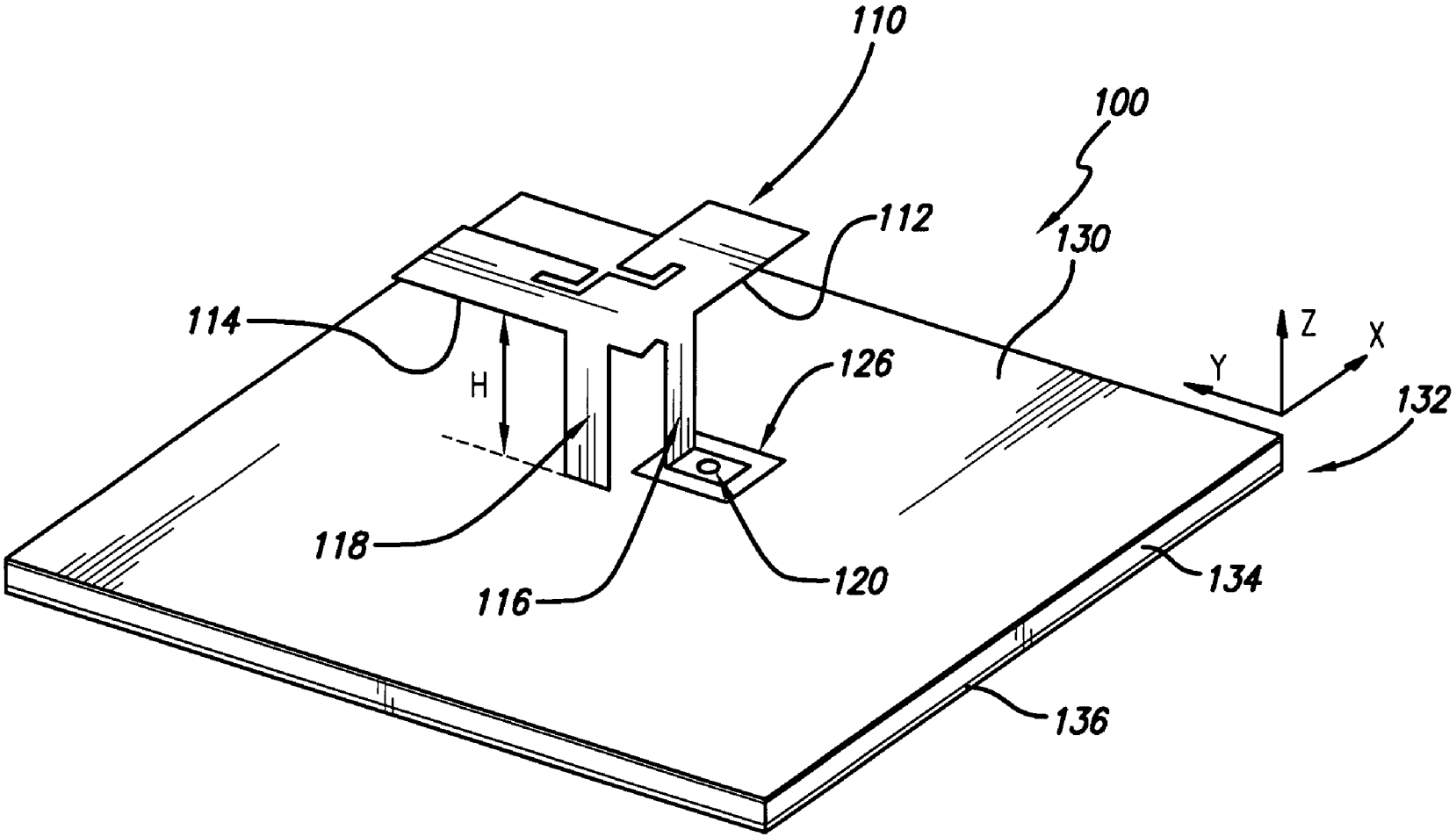
FIG. 1 shows a perspective view of the antenna illustrating the three dimensional structure, according to a preferred embodiment of the present invention.
Figure 2A:
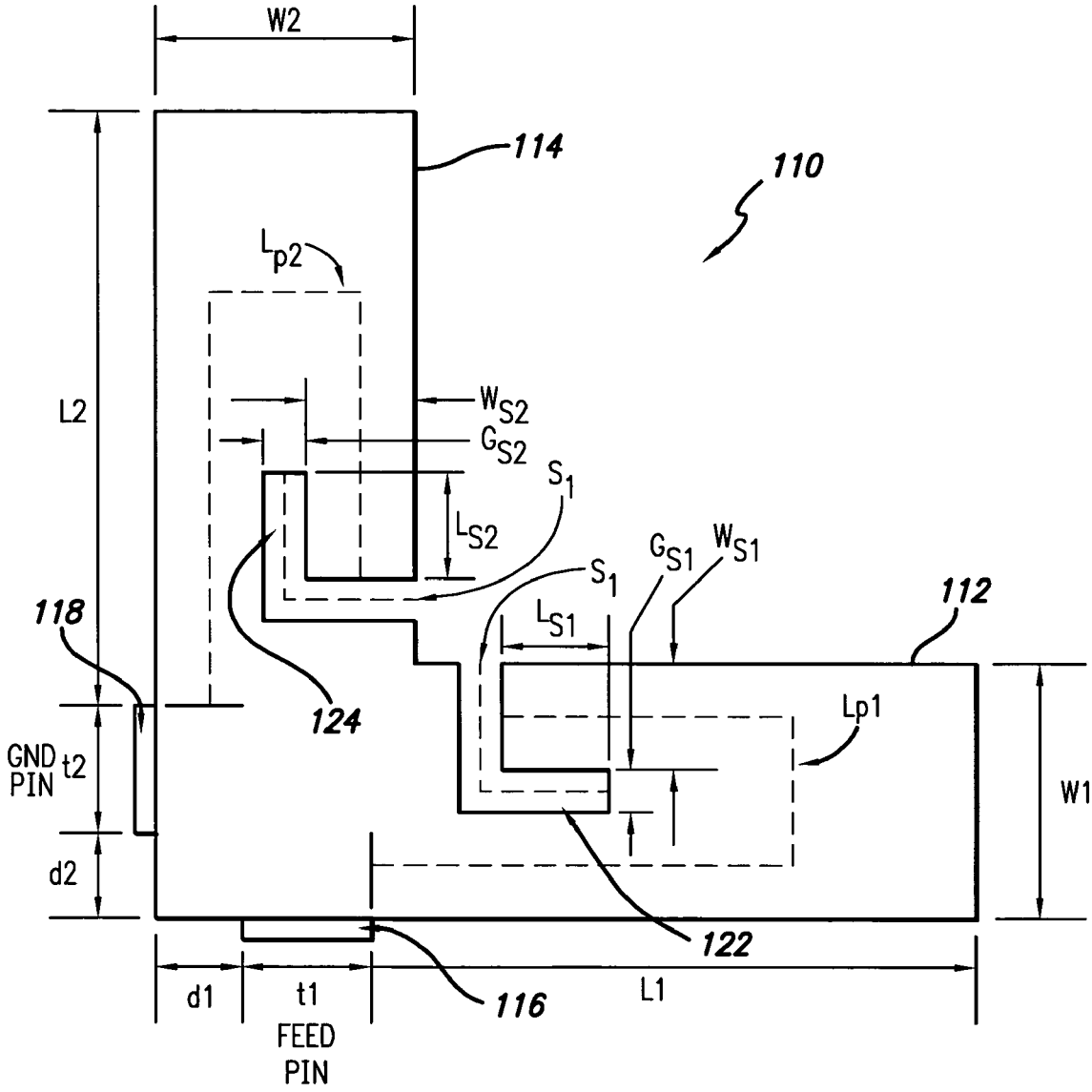
FIGS. 2A and 2B show a top view of the antenna of FIG. 1 illustrating the details of the antenna element layout over the ground plane, according to a preferred embodiment of the present invention.
Figure 2B:
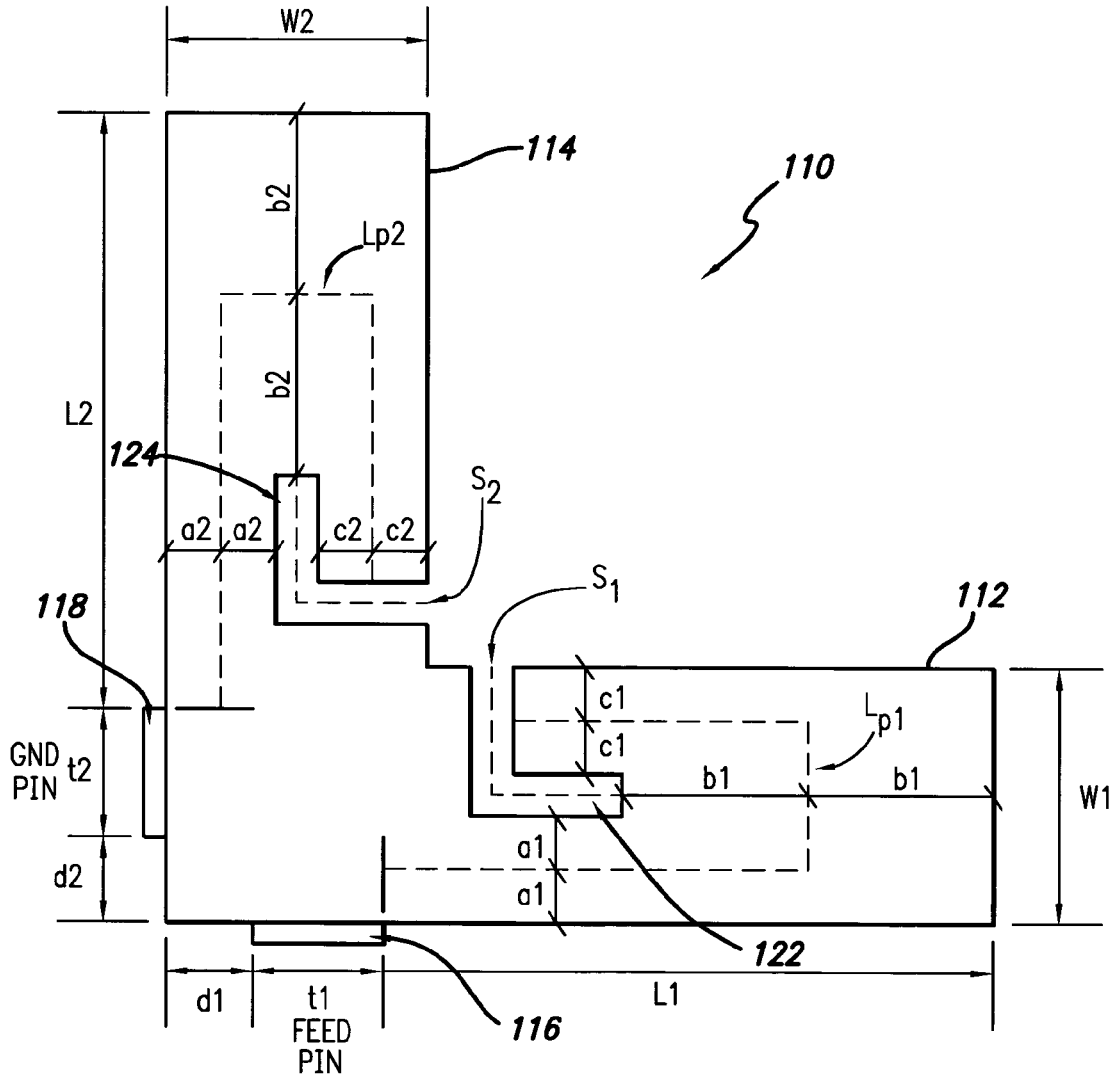

The mechanical structure of the preferred embodiment of the antenna 100 is illustrated in FIG. 1 and FIG. 2A, 2B. FIG. 1 shows a perspective view of the antenna illustrating the three dimensional structure while FIGS. 2A and 2B show a top view illustrating the details of the antenna element layout over the ground plane. Also shown in FIG. 2A, 2B are specific dimensional parameters which may be varied to optimize antenna performance. One specific example of values of such parameters according to one preferred embodiment of the present invention will be described below.

Referring to FIG. 1 and FIG. 2A, 2B, the antenna 100 has a radiating element 110 configured on a planar ground plane 130. For clarity in discussing the three dimensional structure of the antenna, X, Y and Z axes are also shown in FIG. 1, with the X, Y plane corresponding to the plane of the ground plane and the Z direction perpendicular thereto. As may be seen the radiating element 110 extends upward in the Z direction a distance H from ground plane 130 and has two orthogonal antenna branches 112 and 114 forming an L shape. These antenna branches may preferably be planar sheets of a suitable conductor with a planar surface parallel to the X, Y plane of the ground plane 130. For example, an inexpensive thin sheet of copper or aluminum, e.g., 0.2 mm thickness, may be employed. The preferred structure illustrated can be viewed as the superposition of two orthogonal Planar-Inverted-F Antenna (PIFA) antennas. (See R. Garg, P. Bhartia, I. Bahl and A. Ittipiboon, *Microstrip Antenna Design Handbook*, Boston and London: Artech House, 2001, the disclosure of which is incorporated herein by reference.) There is one feeding leg (or pin) 116 coupled to the first branch 112 and one grounding leg (or pin) 118 coupled to the second branch 114, as shown. The feeding pin 116 is coupled to a feeding port 120 which receives the RF signal for transmission. This feeding port is configured in a gap 126 in the conductive layer of the ground plane 130 and is coupled to the RF feed source through a via to the source or to a microstrip feed line in a conventional manner. For example, the ground plane 130 may be formed on a conventional PCB 132 such as FR4 which has an upper copper layer, patterned to form the ground plane with opening 126, a dielectric layer 134 for insulation, and a bottom layer 136 on which the RF feed line may be formed. When excited, the current will flow in orthogonal directions on the surface of antenna radiator branches 112 and 114. Slots 122 and 124 may preferably be provided on the branches 112, 114, respectively. The slots 122, 124 on the antenna branches are used to confine the electric field so that it has less interaction with the objects around the antenna, thus good isolation is obtained.

Referring to FIGS. 2A and 2B, specific dimensional parameters are illustrated which may be adjusted to optimize antenna performance for a particular application. Specifically, the following dimensional parameters may be adjusted to optimize the antenna for the desired application: d1, d2, t1, t2, L1, L2, W1, W2, S1, S2, and H, where the length of the first and second branches are given by L1 and L2, respectively, the width of the first and second branches are given by W1 and W2, respectively, the width of the feeding leg is given by t1, the width of the ground leg is given by t2, the distance of the ground leg from the branch edge adjacent the feeding leg is given by d2, the distance of the feeding leg from the branch edge adjacent the ground leg is given by d1, S1 and S2 are the slot lengths, and the height of the radiating element above the ground plane is given by H (FIG. 1). The parameters a1, a2, b1, b2, c1, c2 are simply provided to illustrate the symmetry of the structure of the branches. $L_{p1}$ and $L_{p2}$ in turn illustrate the general path of current through the antenna branches.

The properties of the antenna may be summarized as follows:

A. Two antenna branches are arranged in a 90 degree configuration. This special arrangement means the antenna can be either linear or circular polarized. When L2=0 (or L1=0), the antenna is linear-polarized; when L1=L2, the antenna is circular polarized. Since there is only one feeding pin, it is easy to obtain circular polarization.

B. The antenna can be designed as either single band or dual-band. When L1=L2 or L2=0 (or L1=0), the antenna is single band; when L2≠L1, a dual-band antenna is obtained. When L2≠L1 but with less difference in length, a wide band antenna is obtained.

C. Even with L2=0 (or L1=0), the multiple-band features still can be obtained by increasing the length of L1 (or L2) and adjusting the length of slot 1 (or slot 2)

D. The function of the feeding leg and grounding leg can be exchanged, that is, the grounding pin can be used as feeding pin, and the feeding pin can be used as grounding pin.

E. The center frequency of the antenna can be adjusted by changing the branch lengths (L1, L2) and slot lengths (S1, S2).

F. The return loss can be adjusted by changing the distance between the feeding leg and grounding leg (d1 and d2).

G. Antenna bandwidth can also be adjusted by changing the height (H) and the width of the branches (W1 and W2).

To determine the dimension of the antenna, one can assume that the quarter-wavelength at resonance is equal to the effective length of the current flow on the antenna surface and the grounding leg. (See for example, K. Hirasawa and M. Haneishi, *Analysis, Design, and Measurement of small and Low-Profile Antennas*, Boston and London: Artech House, 1992, the disclosure of which is incorporated herein by reference.) Thus the following equations (1) and (2) can be used to calculate the resonant frequency of the antenna:

$$L_{p1} + d_1 + t_1 + \frac{H}{2} \approx \frac{\lambda_1}{4} \tag{1}$$

$$L_{p2} + d_2 + t_2 + \frac{H}{2} \approx \frac{\lambda_2}{4} \text{ where:} \tag{2}$$

$$L_{p1} = L_1 + L_{s1} + \frac{W_1}{2} + \frac{G_{s1}}{2} \tag{3}$$

$$L_{p2} = L_2 + L_{s2} + \frac{W_2}{2} + \frac{G_{s2}}{2} \tag{4}$$

$$S_1 = L_{s1} + W_{s1} + G_{s1} \tag{5}$$

$$S_2 = L_{s2} + W_{s2} + G_{s2} \tag{6}$$

And where $\lambda_1$ and $\lambda_2$ are center wavelengths corresponding to the two resonant frequencies of $f_1$ and $f_2$ of the two antenna branches.

The antenna can be single band or dual-band by adjusting the length of the antenna branches and the length of the slots. The return loss can be adjusted by changing the distance between feeding pin and the grounding pin. For some applications an impedance matching section can be added before the input port to improve the return loss and bandwidth. Antenna bandwidth can also be adjusted by changing the height (H) and the width of the two branches (W1 and W2).

Figure 3:
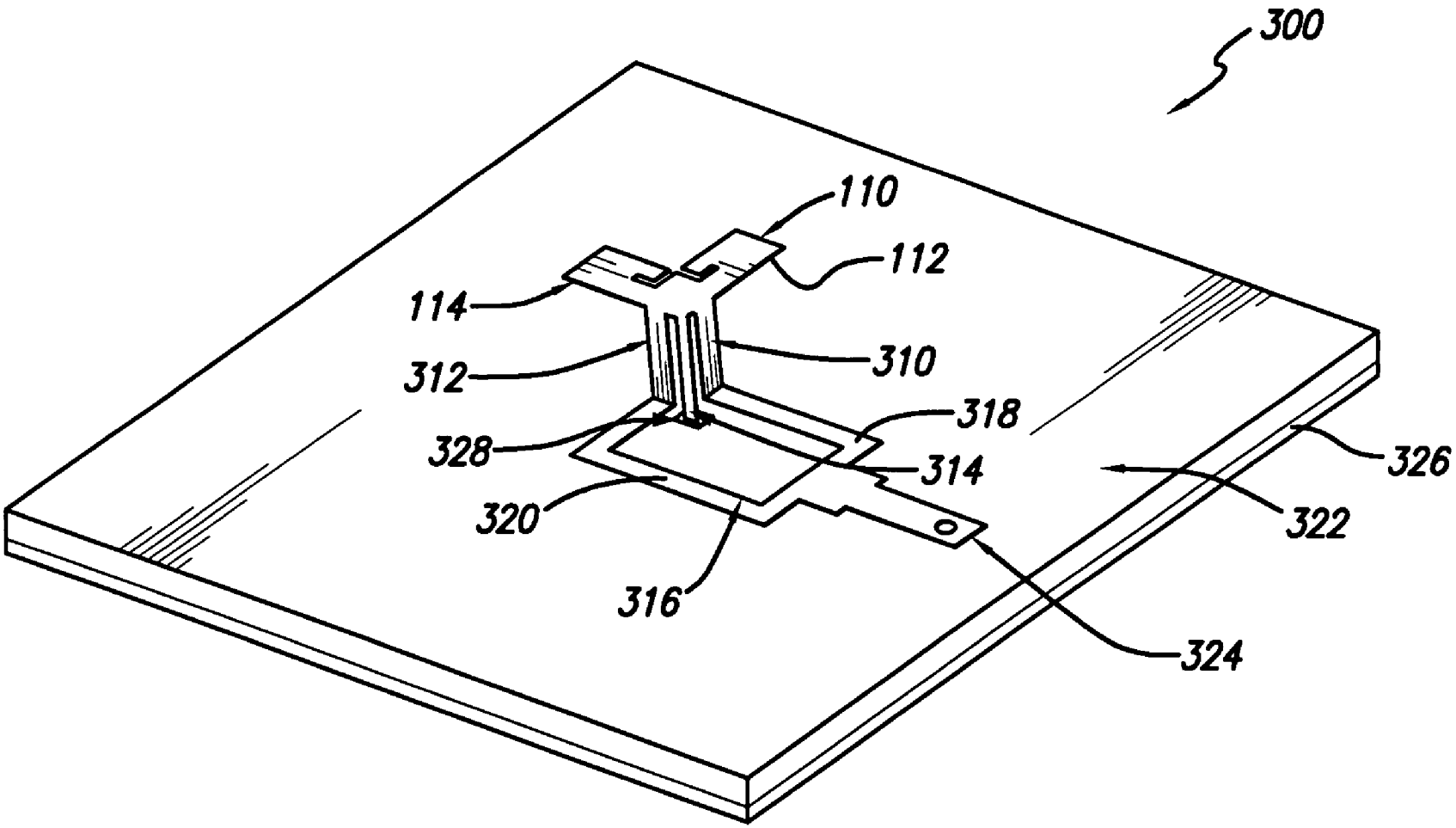
FIG. 3 shows a perspective view of the antenna illustrating the three dimensional structure, according to an embodiment of the present invention adapted for circular polarization.
Figure 4A:
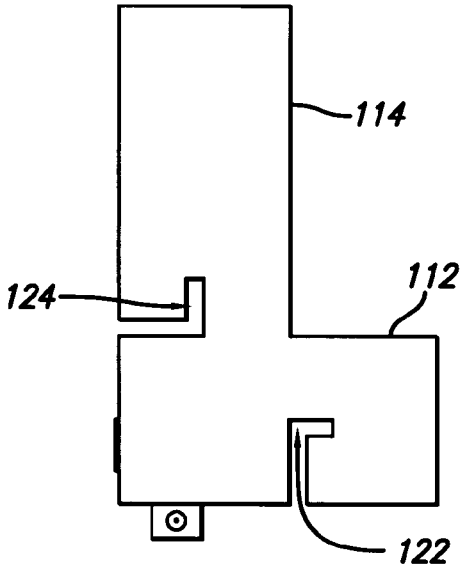
FIGS. 4A-4D are respective top views generally corresponding to FIG. 2 above but showing different slot locations and configurations in accordance with alternate embodiments of the invention.
Figure 4B:
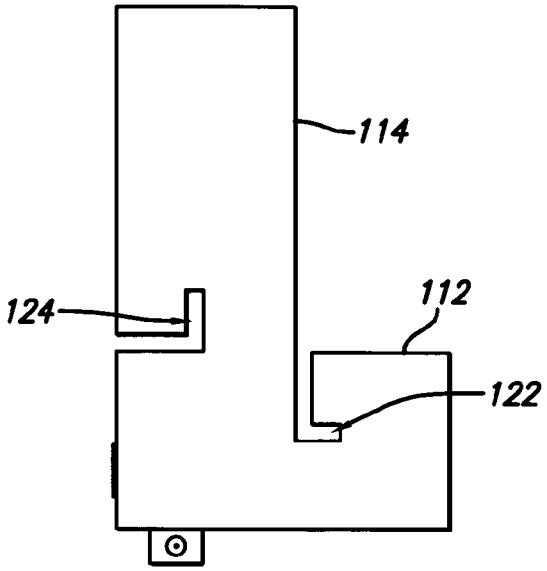
Figure 4C:
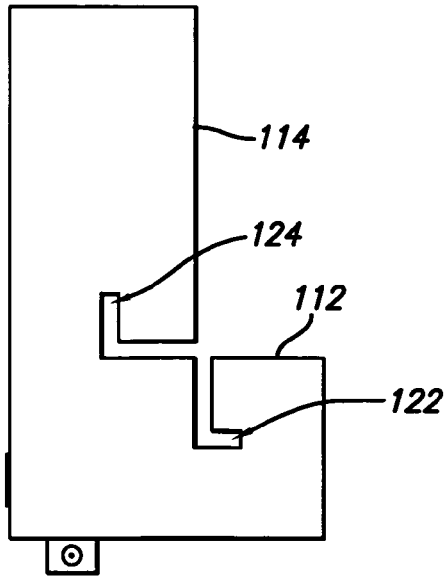
Figure 4D:
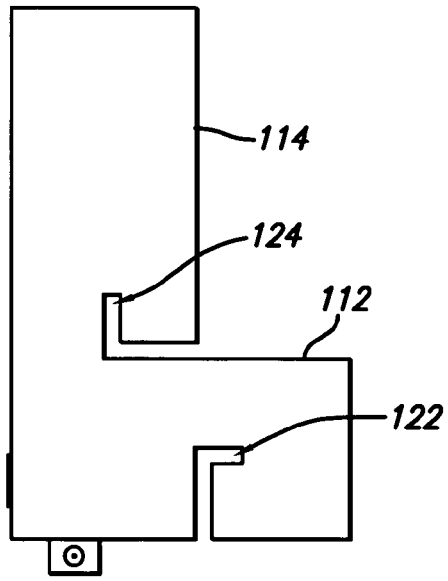

Circular polarization can be obtained if two orthogonal modes are excited with a 90° time-phase difference between them as well known in the art. (See e.g., Constantine A. Balanis, *Antenna Theory: Analysis and Design,* 2nd Edition, New York: J. Wiley & Sons, 1997, the disclosure of which is incorporated herein by reference.) For a circular polarization application, the three dimensional mechanical structure of the antenna 300 is presented in FIG. 3. The basic two branch structure of the radiating element 110 is the same as the embodiment of FIG. 1. The length of the two antenna branches 112, 114 must be equal (L1=L2). In place of the feeding pin 116 there are two feeding pins 310, 312 and one grounding pin 314. The grounding pin 314 is located between the two feeding pins, and the antenna has a symmetrical structure (L1=L2, W1=W2, Slot 1=Slot 2, t1=t2, d1=d2). The pins 310, 312 are provided with the RF signal by a feeding network 316 which has two feeding paths 318, 320 which have 90° phase difference. For example, as shown path 320 may have a longer length than path 318 imparting a 90° phase difference. The feeding network 316 is printed on PCB 322 and coupled to RF source through feeding port 324. The ground plane 326 may be formed on a bottom surface of PCB 322 and ground pin 314 may be connected to the ground plane through a via hole 328. Since L1=L2 and the feeding network branches have 90° phase difference, the antenna has very wide bandwidth.

Referring to FIGS. 4A-4D different slot locations and configurations are shown in respective top views generally corresponding to FIG. 2 above. Slots 122 and 124 are used to confine current/electric filed so that the antenna has good isolation from other components near the antenna. Depending on the application, the slot route direction and location may be selected to optimize performance. Also the above equations may be used to select slot length for the specific application.

Figure 5:
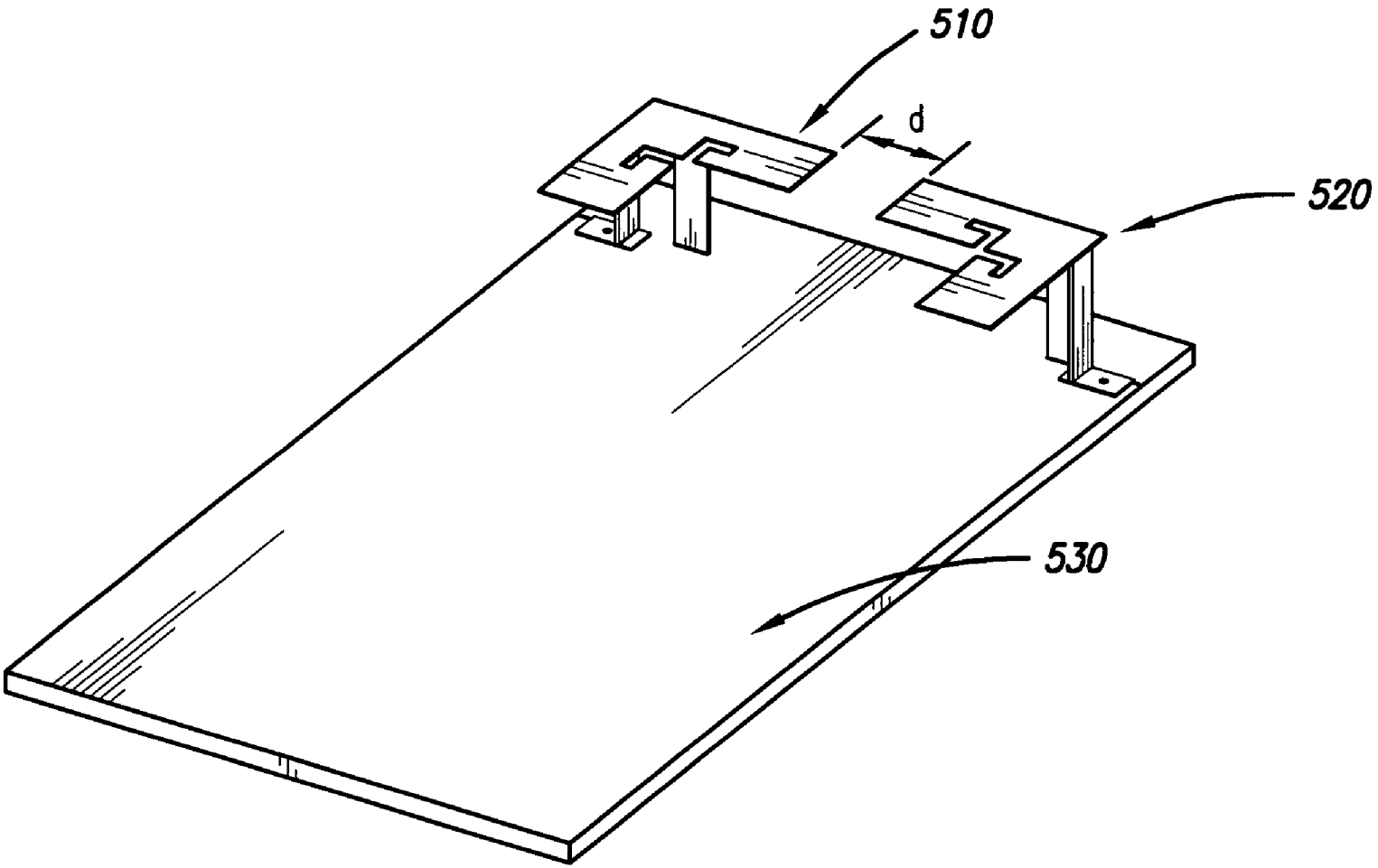
FIG. 5 shows an embodiment of the invention with two antenna elements configured on a ground plane.

FIG. 5 shows an embodiment of the invention having multiple antennas on a ground plane. As one example, such an antenna may be adapted for MIMO (Multiple Input Multiple Output) or diversity applications. One example of such an application is to mobile devices such as cellular phones. The two antennas 510, 520 are located at the two corners of the PCB 530 which also incorporates a ground plane therein. For example, one antenna can be used for GSM bands, and another one can be for GPS or other frequency band such as WiMAX, etc. The structure of the antennas 510, 520 may be in accordance with the teachings described above. To reduce the coupling between the two antennas, besides using different frequency bands, a minimum distance d of separation must be maintained. For example, for a mobile application a minimum distance d of 5 mm should be provided. As another example of a multi-antenna application an antenna array with one or more columns of antenna elements may be provided for beam steering and/or beamwidth adjustment in a cellular base station application. The implementation of such an array will be apparent to those skilled in the art from the foregoing.

As one specific example of the antenna, a low cost, wide band WiMAX antenna (2.5 to 2.69 GHz) has been designed with Momentum of Agilent Advanced System (ADS). The dimensions of the antenna are as follows (with reference to the parameters of FIG. 2):

d1=d2=2 mm
t1=2.8 mm
t2=3.0 mm
L1=11.2 mm
L2=11.0 mm
W1=W2=6.5 mm
H=10 mm

Figure 6:
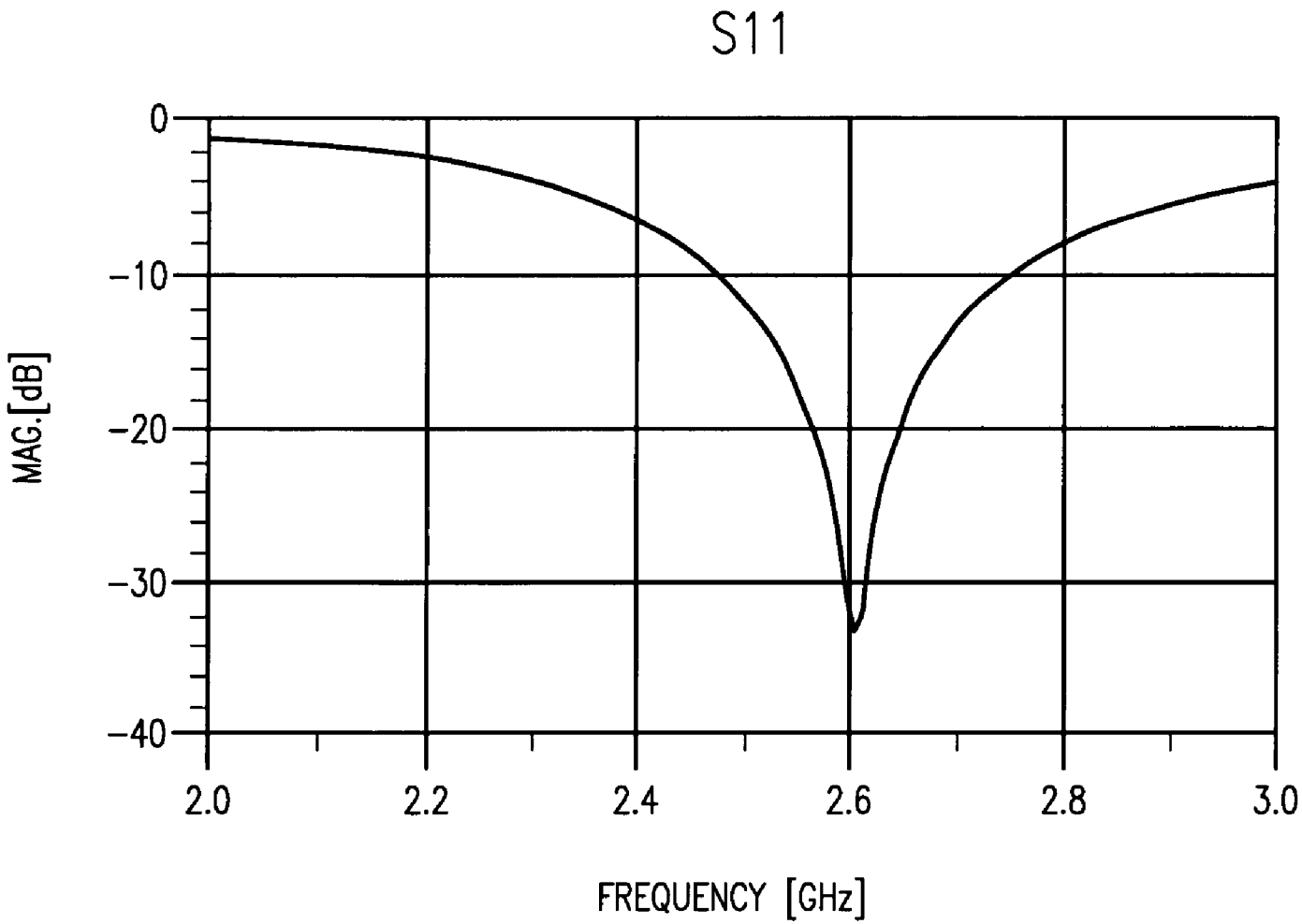
FIG. 6 is a graphical plot of simulated return loss of the antenna for illustrative specific dimensions of the antenna element and specific operating frequency.
Figure 7A:
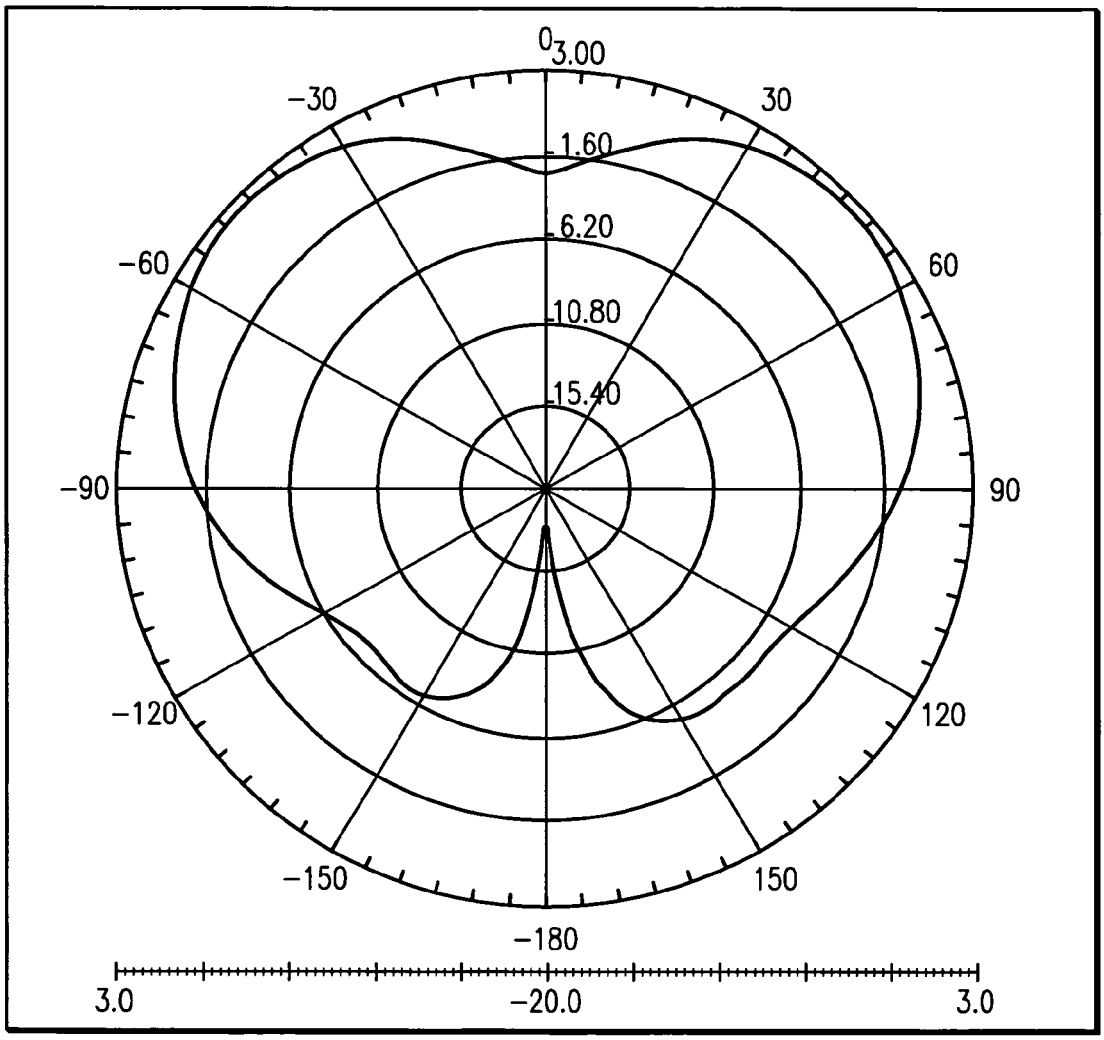
FIGS. 7A and 7B are two dimensional plots of simulated radiation patterns of the antenna for illustrative specific dimensions of the antenna element and specific operating frequency, in XY and YZ planes respectively.
Figure 7B:
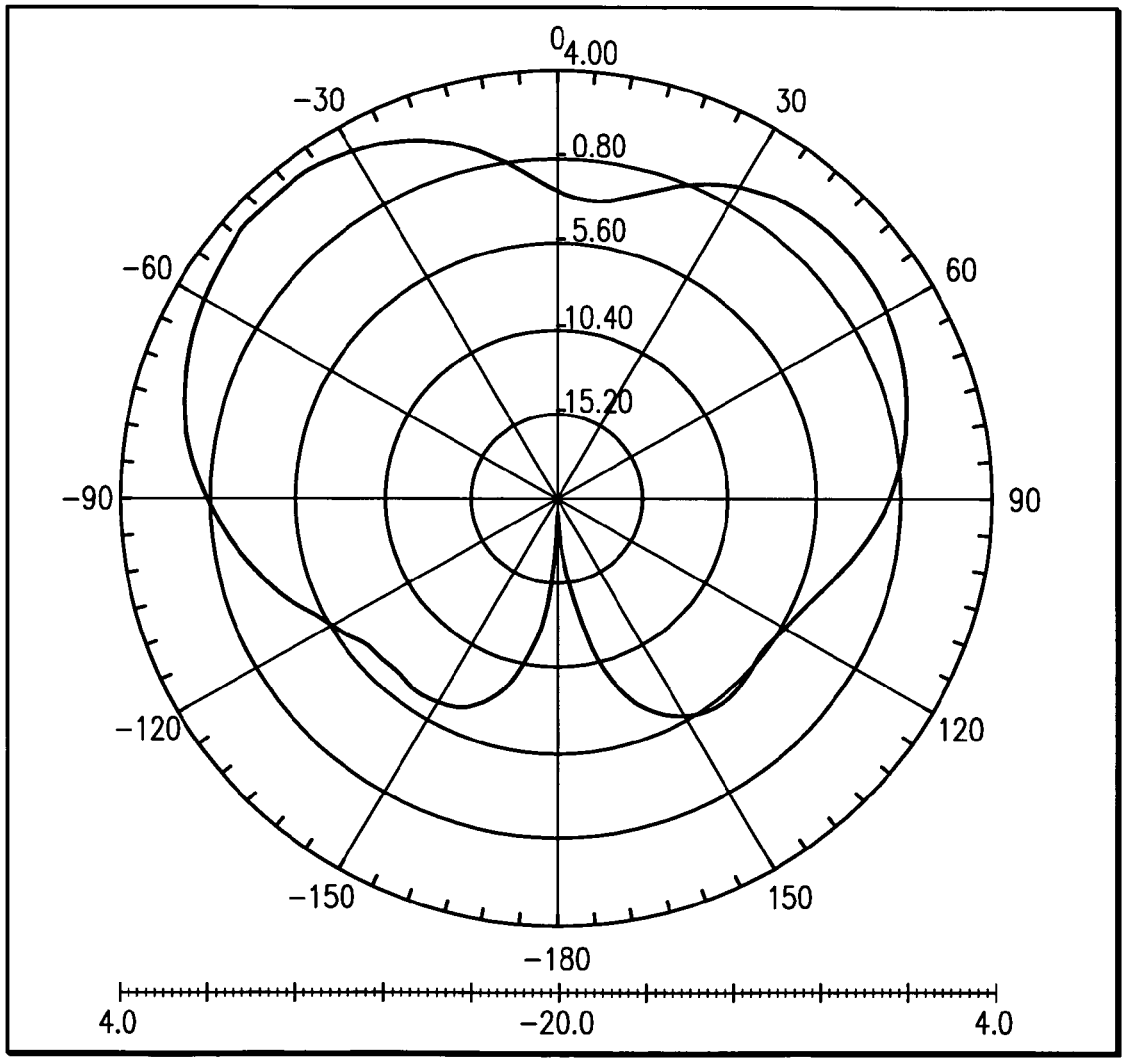

The PCB substrate is FR4 and its thickness is 60 mils (1.524 mm). The dimension of the grounding plane is 200×200 mm. FIG. 6 and FIGS. 7A and 7B show the simulated return loss and the 2D radiation pattern respectively.

The simulated antenna parameters are as follows:

Peak Gain: 3.4dBi (Grounding plane dimension: 200×200 mm)

Effective radiation angle: 330 degree

Figure 8:
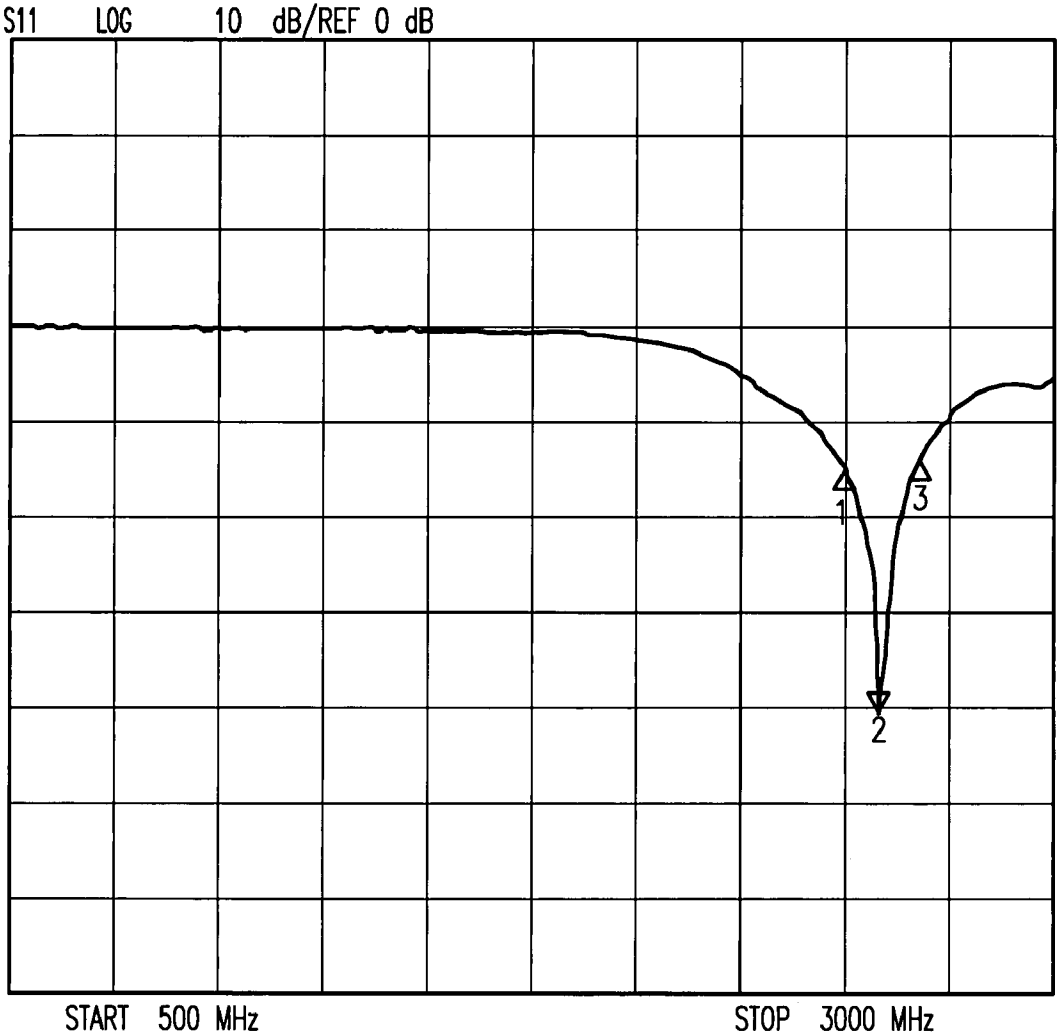
FIG. 8 is a graphical plot of measured return loss of the antenna for the illustrative specific dimensions of the antenna element and specific operating frequency simulated in FIG. 6.

FIG. 8 shows the measured input return loss. It will be appreciated by those skilled in the art that the return loss is excellent. The center frequency is 2588 MHz (data point 2) and the return loss is −40.9 dB. At 2500 MHz (data point 1), the return loss is −14.86 dB; at 2690 MHz (data point 3), the return loss is −13.28 dB. The radiation pattern has also been measured and also closely matches the simulated pattern.

In conclusion, a low cost and multi-featured antenna has been disclosed. Its dimension is less than half of a patch antenna. By varying the branches length and slot length, single and dual band antennas and linear or circular polarized antennas may be provided. This antenna can be applied to different frequency bands in wireless communications, such as SOHO repeater and cellular phone bands such as GSM 850/900/1800/1900, UMTS, WLAN and WiMAX bands etc. It will be appreciated by those skilled in the art that a variety of modifications are possible.

What is claimed is:

1. An antenna, comprising:

a ground plane;

a radiating element mounted to the ground plane and having first and second branches spaced above the ground plane, wherein the first and second branches form a generally L shaped planar structure spaced above the ground plane;

a feeding leg supporting the first branch of the radiating element above the ground plane and electrically coupling the first branch to an RF feeding port; and a grounding leg supporting the second branch of the radiating element above the ground plane and electrically coupling the second branch to the ground plane;

wherein the length of the first and second branches are given by L1 and L2, respectively, the width of the first and second branches are given by W1 and W2, respectively, the width of the feeding leg is given by t1, the width of the ground leg is given by t2, the distance of the ground leg from the branch edge adjacent the feeding leg is given by d2, the distance of the feeding leg from the branch edge adjacent the ground leg is given by d1, and the height of the radiating element above the ground plane is given by H, and wherein the respective antenna dimensions are selected for the desired operating frequency of the antenna.

2. An antenna as set out in claim 1, wherein the first and second branches have respective first and second slots therein.

3. An antenna as set out in claim 2, wherein the first and second slots are L shaped.

4. An antenna as set out in claim 1, wherein the length of the first and second branches are approximately equal.

5. An antenna as set out in claim 1, wherein the length of the first and second branches are different.

6. An antenna as set out in claim 5, wherein the antenna provides dual band operation with operating frequencies determined by the respective lengths of the first and second branches.

7. An antenna as set out in claim 1, wherein the radiating element comprises a thin sheet of conductive material.

8. An antenna as set out in claim 2, wherein the first and second slot lengths are selected for the application.

9. An antenna as set out in claim 1, wherein d1≈d2 and is about 2 mm, t1 is about 2.8 mm, t2 is about 3.0 mm, L1 is about 11.2 mm, L2 is about 11.0 mm, W1≈W2 and is about 6.5 mm, and H is about 10 mm.

10. An antenna as set out in claim 9, wherein the antenna is adapted for WiMAX applications and the operating frequency is about 2.6 GHz.

11. An antenna as set out in claim 1, wherein antenna bandwidth is adjusted by changing the height (H) and the width of the two branches (W1 and W2).

* * * * *